United States Patent [19]

Plangger et al.

[11] Patent Number: 4,582,434

[45] Date of Patent: Apr. 15, 1986

[54] TIME CORRECTED, CONTINUOUSLY UPDATED CLOCK

[75] Inventors: David Plangger, Stevensville; Wayne K. Wilson, St. Joseph, both of Mich.

[73] Assignee: Heath Company, St. Joseph, Mich.

[21] Appl. No.: 602,844

[22] Filed: Apr. 23, 1984

[51] Int. Cl.[4] ..... G04C 11/02

[52] U.S. Cl. ..... 368/46; 368/47

[58] Field of Search ..... 368/10, 46, 47, 49, 368/51, 52, 200–202; 375/107, 118

[56] References Cited

U.S. PATENT DOCUMENTS

| | | | |
|---|---|---|---|
| 3,530,663 | 9/1970 | Marti . | |
| 4,117,661 | 10/1978 | Bryant, Jr. | 368/47 |
| 4,234,958 | 11/1980 | Pipes et al. | 368/47 |
| 4,440,501 | 4/1984 | Schultz | 368/202 |

*Primary Examiner*—Vit W. Miska

[57] ABSTRACT

Time referenced RF signals are periodically received and processed for updating a microprocessor-controlled clock. The clock automatically scans several frequencies at which the coded RF timing signals are transmitted, selecting the strongest received signal for synchronization therewith and causes a capture LED to be illuminated upon detection of a sufficiently strong signal at the beginning of a minute tone at one of the received frequencies. The microprocessor periodically determines the timing difference between an internal timer and the received RF timing signals. A time difference correction is provided to a digital-to-analog converter which provides an appropriate voltage to a varactor diode in a crystal oscillator circuit for adjusting the microprocessor's operating frequency until it can no longer resolve a difference between the received RF timing signals and its internal timer. This permits highly accurate clock operation in between the periodic reference time updates and eliminates cumulative time error. Manual switches are provided for correcting for received signal propagation delay and for selecting the appropriate time zone as well as for allowing for daylight saving time and $UTC_1$ correction. In addition, the microprocessor-controlled crystal oscillator ensures accurate time-keeping when the transmitted RF timing signals are too weak for clear reception.

15 Claims, 4 Drawing Figures

TIME CORRECTED, CONTINUOUSLY UPDATED CLOCK

BACKGROUND OF THE INVENTION

This invention relates generally to a timing signal referenced clock and is particularly directed to a clock periodically updated by a received reference timing signal, and wherein the clock's internal timing circuit is corrected for more accurate operation in between the periodic clock updates.

Atomic resonance can be used to provide time scales having a high degree of uniformity and reproducibility. Thus, an atomic clock with a cesium-atom oscillator loses only one second every 370,000 years and is thus stable to one part in $10^{12}$. Despite this high degree of accuracy, atomic-based units of time are not used for general measurement purposes as the occurrence of events are generally measured and recorded in terms of solar, or sidereal, time. This time scale is based upon the mean time of rotation of the earth about its axis in relation to the vernal-equinox point in the sky. It is determined by observing the meridian transits of stars. The mean sidereal day is 23 hours, 56 minutes, and 4.09 seconds. Because of variations in the rotational speed of the earth, sidereal time is not perfectly uniform.

A universal time scale, also known as Greenwich Mean Time or Universal Coordinated Time (UTC), is based on the mean angle of rotation of the earth about its axis in relation to the sun. It is referenced to the prime meridian that passes through Greenwich, England. In UTC, an atomic clock provides the basic intervals of time and, when necessary, corrections are made to keep the clock in agreement with solar time. In this way, UTC maintains accurate solar time while providing the time-interval precision required by many sciences and businesses, such as in the fields of astronomy and communications. For practical purposes, UTC can be considered as solar time measured at the prime meridian (Greenwich Mean Time), but the basic intervals of UTC are counted by the much more precise atomic clock.

In order to provide a worldwide time reference signal, various radio frequency (RF) transmitter stations synchronized with a master standard atomic clock maintained by the Bureau International de L'Heure (BIH) in Paris are located throughout the world. The National Bureau of Standards (NBS) provides the standard reference time for the United States by broadcasts from standard frequency and time stations in Colorado (WWV) and Hawaii (WWVH). The regular (WWV) carrier at 2.5, 5, 10, 15 and 20 MHz uses a 1000 Hz amplitude modulating tone burst to signal the beginning of each minute. WWVH uses a 1200 Hz amplitude modulating tone burst. A 100 Hz subcarrier contains binary coded decimal (BCD) signals that supply day-of-the-year, hour and minute information. Complete BCD information in the form of a frame is transmitted each minute. This information is encoded by controlling the width of the 1-second subcarrier pulses. This BCD time information is updated every minute. Also contained in the BCD signals are UT1 data which provides a correction for periodic variations in the speed of rotation of the earth and normal/daylight saving time data.

To date, laboratory reference oscillators for receiving the aforementioned time-based signals for use as frequency standards are available. However, there is not presently known a clock capable of receiving and displaying the time provided by the aforementioned WWV and WWVH time-based signals. The present invention is therefore intended to provide a relatively low cost, easily installed and aligned clock which is capable of receiving UTC time signals on any one of three frequencies, displaying the time to an accuracy of ±10 milliseconds, and regularly and continuously updating the timing of a microprocessor used to control the clock. The present invention is not subject to the timing inaccuracies inherent in a temperature-stabilized crystal oscillator circuit nor does it exhibit the cumulative time error inherent in atomic clocks.

OBJECTS OF THE INVENTION

Accordingly, it is an object of the present invention to achieve a degree of time-keeping accuracy not available in conventional clocks.

It is also an object of the present invention to provide a highly accurate clock which is periodically updated by a received reference time signal.

Another object of the present invention is to provide for more accurate operation in a clock by periodic updating of the clock by a received reference time signal and by correcting clock operation in the inter-update periods in accordance with the received reference time signal.

Still another object of the invention is to provide for the automatic tuning of a clock receiver to the strongest received reference time signal in a multi-frequency standard time signal transmission system.

A further object of the present invention is to provide a highly accurate clock which is capable of receiving standard time broadcasts in North America and the Pacific Ocean area and within 3,600 miles of Colorado or Hawaii.

A still further object of the present invention is to provide a highly accurate time standard-referenced clock capable of operating in WWV or WWVH reception areas and of correcting for daylight saving time.

Yet another object of the present invention is to provide a microprocessor-based system in which more accurate microprocessor operation is achieved by continuous updating of its reference clock by a received time standard signal.

Another object of the present invention is to provide a low cost, highly accurate clock which is referenced to a worldwide transmitted reference time signal.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
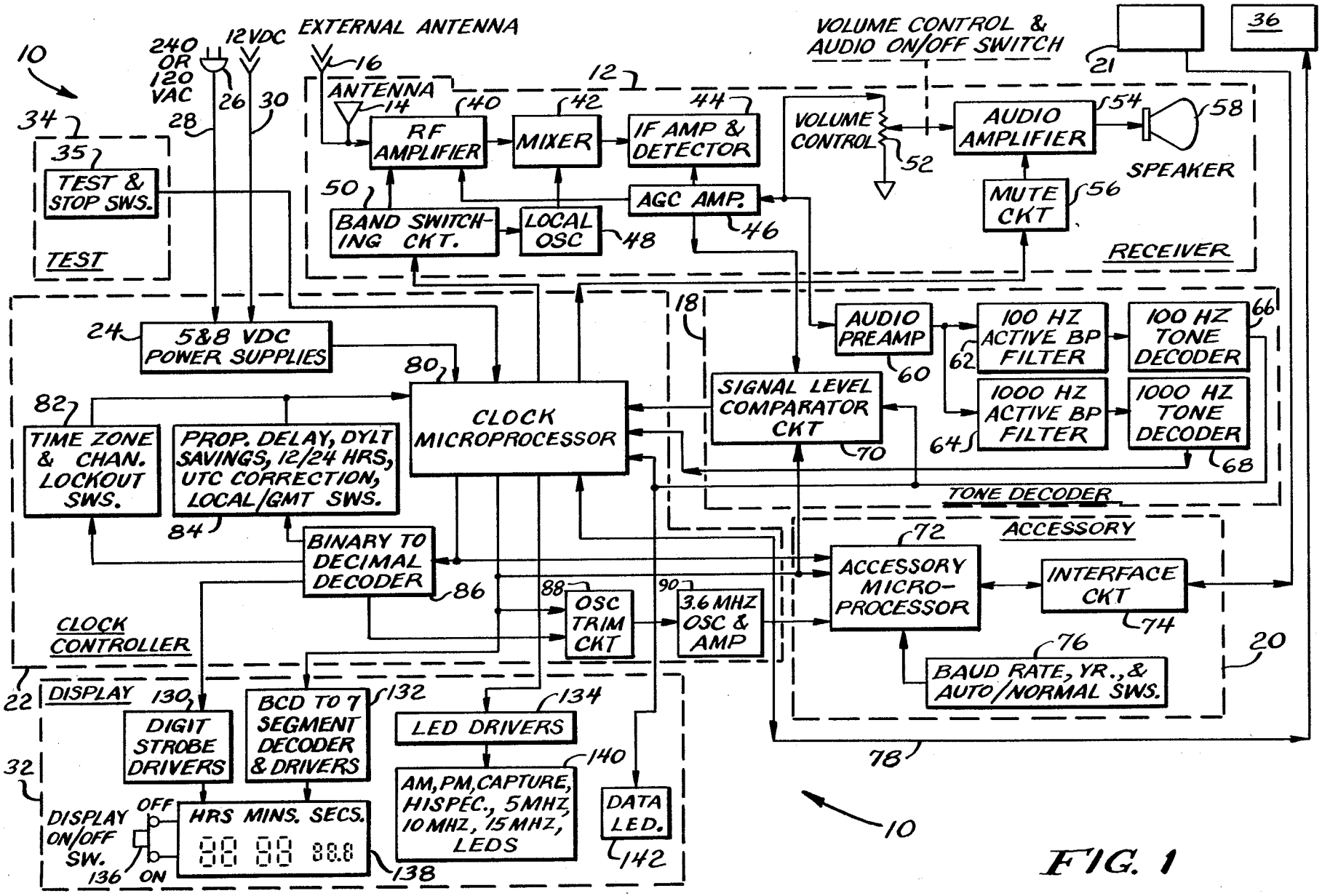
FIG. 1 is a combined schematic and block diagram of a time corrected, continuously updated clock in accordance with the present invention.

Referring to FIG. 1, there is shown in simplified block and schematic diagram form a time corrected, continuously updated clock 10 in accordance with the present invention.

Among the several tones, ticks, and voice signals provided on WWV/WWVH, there is a time code which is decoded by the continuously updated clock 10 which displays the hour and minute information provided in the transmitted signal. The time code is located 100 Hz from the carrier signal, i.e., at 5, 10, or 15 MHz, and is called the "subcarrier". The code pulses are transmitted once every second in a modified IRIG-H format. After suitable identifiers are sent, the bits that make up the units, tens, and hundreds for minutes, hours, and days are sent sequentially. Certain pulses in succession comprise binary-coded groups which represent numbers.

Within a time frame of one minute, enough pulses are transmitted to convey, in BCD language, the current minute, hour, and day of the year. Two BCD groups are needed to show the hour and the minute (00 through 23 and 00 through 59); and three groups are needed to show the Julian date (001 through 366). With the coded information referring to time at the beginning of a 1-minute frame, seconds in that 1-minute frame can be determined by counting pulses within the frame. This is used to determine which data is being received (hours, minutes, $UTC_1$,etc.), but not for generating the seconds of the displayed time. Each frame begins with a unique spacing of pulses to mark the beginning of a new minute. For synchronization purposes every 10 seconds a position identifier pulse is transmitted which consists of 77 cycles of 100 Hz (770 milliseconds duration). The UTl corrections to the nearest 0.1 second are broadcast via BCD pulses during the final 10 seconds of each frame and are termed control functions. These control functions indicate such things as whether the UTl correction is negative or positive, the amount of correction, and whether daylight saving time or standard time is in effect. The WWV/WWVH transmissions also include voice announcements.

Because signals such as those transmitted by WWV tend to fade, it is possible to lose some of the code bits. As these errors occur, any clock driven directly from a WWV receiver would display the incorrect time. This is overcome in the present invention by means of a tone decoder circuit 18 and a clock controller circuit 22 which includes a clock microprocessor 80 for detecting and eliminating these errors in controlling clock operation. One frame is decoded by the tone decoder circuit 18 and stored electronically as digital bits in clock microprocessor 80. The next frame is received and stored in another location within clock microprocessor 80. If the two frames do not differ by exactly one minute, an error has occurred, and the continuously updated clock 10 will not use this information to correct its time. The first data is discarded and another try is made until several, i.e., three, successful decodes have been made.

The continuously updated clock 10 includes an RF receiver circuit 12 which is a heterodyne, amplitude modulated receiver, designed to receive the 5, 10, and 15 MHz WWV broadcast signals. The receiver includes a telescoping internal antenna 14 as well as an external antenna connector 16 coupled to an RF amplifier 40. An amplified RF signal is provided to a mixer circuit 42 to which is also provided the reference frequency output of a local oscillator circuit 48. In a preferred embodiment, local oscillator 48 provides a 5.455 MHz signal to mixer circuit 42 for mixing with the received RF signal. When the 5 MHz WWV signal is tuned to, the 5 MHz signal from the RF amplifier 40 and the 5.455 MHz signal from the local oscillator 48 are mixed in mixer circuit 42 to produce a difference frequency of 455 kHz (the IF frequency). This IF signal is then amplified and filtered in an IF amplifier and detector 44 for recovery of the 100 Hz and 1000 Hz tones from the WWV signal. These audible frequencies are coupled to a tone decoder circuit 18 as well as to an audio amplifier circuit 54 via a volume control comprised primarily of variable resistor 52.

A clock microprocessor 80 within the clock controller circuit 22 applies a 2-bit binary coded signal to a bandswitching circuit 50 within receiver 12. This causes the bandswitching circuit 50 to output an appropriate bandswitch signal to RF amplifier 40 in tuning to either the 5, 10 or 15 MHz WWV signal. By means of diode switching within bandswitching circuit 50, certain tuned circuits and crystals are selected within RF amplifier 40 and local oscillator 48 to permit the receiver 12 to receive the desired WWV channel.

An automatic gain control (AGC) amplifier circuit 46 is coupled to the RF amplifier 40 and the IF amplifier and detector 44 for filtering out the audio signal from the received RF signal while producing a DC voltage which is inversely related to the average amount of IF signal coupled to the IF amplifier and detector 44. This DC voltage is the AGC voltage and is used to control the gain of the RF amplifier 40 and the IF amplifier in maintaining a nearly constant audio signal level over wide variations in the received RF signal level. The AGC voltage is also coupled to a signal level comparator circuit 70 which assists the clock microprocessor 80 to determine which WWV channel is the strongest. The audio signal, which passes through the volume control 52, is coupled to the input of an audio amplifier 54 which amplifies this signal and provides it to a speaker 58. The clock microprocessor 80 provides a control signal to a mute circuit 56 for controlling audio amplifier 54 in either blocking audio signals from speaker 58 or permitting the audio portion of the received RF signal to be provided to and emitted from speaker 58.

The primary function of the tone decoder circuit 18 is to detect the 1000 Hz and 100 Hz tones sent on the WWV carrier signals. The receiver circuit 12 detects the audio signals amplitude modulating (AM) the carrier. The audio signal is amplified by an audio preamplifier circuit 60 and is then provided to 100 and 1000 Hz active bandpass filters 62, 64. The 100 and 1000 Hz active bandpass filter circuits 62, 64 reject some of the unwanted audio signals and amplify the desired 100 Hz and 1000 Hz signals, respectively. The 100 Hz tone is predominant and is passed by active bandpass filter 62 to a 100 Hz tone decoder 66. The 100 Hz tone decoder 66 contains a phase locked loop (PLL) circuit (not shown) which has a voltage controlled oscillator (VCO, also not shown). When the input signal is very close to the same frequency of the tone decoder's VCO, an error signal is detected and corrects the VCO frequency to make it the same as the input signal frequency. When both the input and VCO frequencies are the same and in phase, the output of the 100 Hz tone decoder 66 will go low, causing the data light emitting diode (LED) 142 in the display circuit 32 to turn on and indicate to the clock microprocessor 80, which monitors the output of the 100 Hz tone decoder 66, that a 100 Hz signal is being received. The clock microprocessor 80 also times the length that the tone is present to decide if it is a binary "0", "1", a 10 second marker, or an invalid signal. In the same manner, the 1000 Hz tone decoder 68 detects at or near 1000 Hz when its VCO frequency is adjusted properly. The clock microprocessor 80 monitors this output and also uses the information to determine when the beginning of a minute occurs, i.e., 00.0 seconds. If the clock microprocessor 80 determines that the proper 1000 Hz tone has occurred, it provides an output signal to an LED driver circuit 134 for illuminating the capture LED in a status LED display 140.

The signal level comparator circuit 70 in the tone decoder 18 compares eight different voltage levels from the clock microprocessor 80 with the receiver AGC voltage from the AGC amplifier 46. In response to this comparison, the signal level comparator circuit 70 indicates to the clock microprocessor 80 which receiver channel is receiving the best, or strongest, WWV signal. The manner in which this is accomplished is described in detail with respect to FIG. 2.

An accessory device 21, such as a computer, may be coupled to an accessory interface system 20 in order to be provided with an accurate timing signal from the continuously updated clock 10. The accessory interface system 20 is provided for interfacing the continously updated clock 10 with such an accessory 21. The interface accessory system 20 includes an accessory microprocessor 72 which receives time and date information from the clock microprocessor 80 in the clock controller circuit 22. Accessory 21 requests the time and date from the accessory microprocessor 72 by sending a low-to-high transition signal via accessory interface circuit 74 to the accessory microprocessor 72. Accessory microprocessor 72 senses this low voltage and sends the desired information to the accessory 21. Accessory microprocessor 72 sends the time in the same format as displayed by the continuously updated clock 10, while date information is provided in Julian format, i.e., day of the year, with the accessory microprocessor 72 converting the date into a month/day format and reading the year select switch settings from a dip switch 76 to compute the year and correct the date for a leap year when necesssary. When the accessory 21 requests information, the accessory microprocessor 72 checks other settings of the dip switch 76 to determine the baud rate and the number of stop bits to be used in the accessory serial information. Another accessory device 36 such as a frequency counter may be coupled to the oscillator and amplifier circuit 90 in the clock controller 22 for receiving the reference oscillator output signal.

A display circuit 32 is coupled to and driven by the clock controller 22. The display circuit 32 is multiplexed, with no more than one digit turned on at any given time. However, each digit therein is turned on approximately 100 times each second. This gives the appearance that all digits are turned on simultaneously. The clock microprocessor 80 sends the appropriate BCD signals to a BCD-to-7-segment decoder and drive circuit 132 within the display circuit 32. The BCD-to-7-segment decoder and driver circuit 132 decodes the signals into the 7-segment format of the LED digits in the digital display 138 and turns the appropriate segment driver pairs on. At the same time, the clock microprocessor 80 sends a 4-bit binary code to a binary-to-decimal decoder 86 within clock controller 22 and causes one of its output lines to turn on the desired digit driver transistor within a digit strobe driver circuit 130. This digit is turned on for approximately 1.25 milliseconds. Then the clock microprocessor 80 outputs different signals to light the next digit. This procedure is repeated again and again. Included in the display circuit 32 is a display ON/OFF switch 136 for turning the digital display 138 on and off to conserve power while permitting the clock to continue to operate.

The individual LED indicators in the status LED display 140 are energized via an LED driver circuit 134 by the clock microprocessor 80. The individual LED indicators in the status LED display 140 are driven statically, i.e., they are either on or off as directed by their function and are not rapidly turned on and off like the aforementioned LED digits. The clock microprocessor 80 decides which LED's in the status LED display 140 to turn on and supplies a high signal (approximately 5 VDC) to appropriate transistors within LED driver circuit 134 connected to the LED's to be lit.

Referring more specifically to the clock controller 22 of FIG. 1, which is shown in greater detail in FIG. 2, the manner in which the clock 10 is time corrected and continuously updated will now be described. A DC power supply 24 is coupled to either an AC source via plug 26 and line 28 or a DC source via input line 30. The DC power supply 24 is coupled to and energizes the clock microprocessor 80. In a preferred embodiment, the clock microprocessor 80 is a masked programmed Mostek 3870 microprocessor. Non-programmed versions of this microprocessor are available from Mostek Corporation of Carrollton, Tex. Microprocessor 80 monitors the outputs of the 100 Hz and 1000 Hz tones from the 100 Hz and 1000 Hz tone decoders 66, 68, respectively. The 100 Hz tone decoder output is provided to pin 38 of microprocessor 80, while the 1000 Hz tone decoder output is provided to pin 28 thereof. The time code signal is located 100 Hz from the carrier signal and is called the "subcarrier". These coded pulses are sent out once every second and are provided to pin 38 of microprocessor 80. Within a time frame of one minute, enough coded pulses are transmitted to convey, in BCD language, the current minute, hour, and day of the year. Two BCD groups are needed to show the hour and the minute (00 through 23 and 00 through 59); and three groups are needed to show the day of the year (001 through 366). When representing units, tens or hundreds, the basic 1-2-4-8 weights are simply multiplied by 1, 10 or 100 as appropriate. The coded information always refers to time at the beginning of the 1-minute frame and seconds can be determined by counting pulses within a given frame.

Each frame begins with a unique spacing of pulses to mark the beginning of a new minute. No 100 Hz pulse is transmitted during the first seconds space, or a hole occurs in the pulse train at that time. Because all 100 Hz pulses in the time code are 30 milliseconds late with respect to UTC, each minute actually begins 1.03 seconds prior to the leading edge of the first 100 Hz tone in the new frame. For synchronization purposes, every 10 seconds a position identifier pulse is transmitted. Unlike the BCD pulses, the position identifiers consist of 77 cycles of 100 Hz. Microprocessor 80 decodes this timing information and provides it to various portions of the continuously updated clock 10 as described below.

The regular WWV carrier at 5, 10 and 15 MHz uses a 1000 Hz amplitude modulating tone burst to signal the beginning of each minute. WWVH from Hawaii uses a 1200 Hz amplitude modulating tone burst. This decoded tone burst is provided to pin 28 of microprocessor 80 from the 1000 Hz tone decoder 66 in the tone decoder circuit 18. It is this tone burst signal at the beginning of each minute which is used by the clock microprocessor 80 in its subsequent time keeping operation. The receipt of this 1000 Hz tone burst is used to increment counters (not shown) within the clock microprocessor 80 in measuring the passage of time from receipt of this 1000 Hz tone burst. This timing cycle is compared with an internal software timer within microprocessor 80. By thus comparing the clock rate at which it executes its operating program with a reference time signal, the clock microprocessor 80 is able to compare the frequency of its clock with a frequency standard. This comparison is performed internally within microprocessor 80 and, based upon the results of this comparison, microprocessor 80 provides various outputs to a binary-to-decimal decoder 86 and to a latch circuit 91. If a difference exists between the WWV reference time and the operating time of the clock microprocessor 80, the clock microprocessor 80 provides outputs via its $P_0$ port, pins 16–19, to latch circuit 91. In addition, clock microprocessor 80 provides various outputs via pins 3–6 to the A, B, C and D inputs of the binary-to-decimal decoder 86. In a preferred embodiment, the clock microprocessor 80 outputs these signals only if the difference between the WWV reference time and its operating clock does not exceed a predetermined limit, i.e., 10 milliseconds. If this limit is exceeded, the clock microprocessor 80 merely updates its internal operating clock to coincide with the WWV reference time. This would typically occur when power is initially applied to the clock for it is then that the microprocessor's internal clock would, in general, differ by more than 10 milliseconds from the WWV reference time.

In response to appropriate outputs from the $P_0$ port of clock microprocessor 80, the $Q_8$ output of binary-to-decimal decoder 86 will go high to low providing an $ST_1$ (STROBE) input to latch circuit 91 causing the $D_0$–$D_3$ inputs thereto to be latched therein. For example, if the A, B and C inputs to the binary-to-decimal decoder 86 are low, and its D input is high, the $Q_8$ output therefrom will be switched from low to high, then when different inputs are placed on the A–D input pins, $Q_8$ goes low resulting in the latching of all four of the $D_0$–$D_3$ inputs into latch circuit 91. A similar strobe signal is provided from the $Q_9$ output of decoder 86 to the $ST_2$ input of latch circuit 91 for latching data from the clock microprocessor into its $D_4$–$D_7$ ports. Data representing a time correction signal is thus provided from the clock microprocessor's $P_0$ port, pins 16–19, to the $D_0$–$D_3$ and $D_4$–$D_7$ ports of latch circuit 91 in a multiplexed manner. Initially, a hexadecimal number in the middle of the frequency trimming range over which the clock microprocessor 80 is capable of selecting is latched into latch circuit 91. For example, when the clock is initially turned on, the number 127 is provided to latch circuit 91 which represents the middle of the range of 0 to 255 over which the clock microprocessor 80 can correct using eight bits. Typically, after initial turn-on, the clock oscillator for clock microprocessor 80 will be within 36 Hz of the desired 3.6 MHz internal time base frequency. The use of 256 bits, with each bit representing approximately 1 Hz, permits the clock microprocessor 80 to adjust its operating time approximately 120 Hz above and below the nominal clock oscillator frequency.

Data from the clock microprocessor 80 representing an adjusted time correction signal latched into latch circuit 91 is then provided to a resistive ladder network 92. The output voltage of the resistive ladder network is a DC voltage proportional to the 8-bit digital value provided from the clock microprocessor 80 to latch circuit 91. Resistive ladder network 92 includes a plurality of resistors and, in combination with latch circuit 91, serves as a digital-to-analog (D/A) converter in transforming the binary output from clock microprocessor 80 representing the difference between the microprocessor frequency and the received WWV reference frequency into an analog voltage representing this frequency difference. Each time one of the resistors within the resistive ladder network 92 is grounded by virtue of a respective output from latch circuit 91, a change occurs in the output of the resistive ladder network 92 which is provided to the base of NPN transistor 93 via resistor 94. NPN transistor 93 serves as a buffer amplifier between the oscillator trim circuit 88 comprised of latch circuit 91 and resistive ladder network 92 and an oscillator circuit comprised primarily of a varactor diode 98, an oscillator crystal 100, and an NPN oscillator transistor 104.

The output from the emitter of NPN transistor 93 is provided to the cathode of varactor diode 98. The anode of varactor diode 98 is connected to ground via resistor 99, reverse biasing varactor 98. This condition causes the junction of varactor diode 98 to act as a capacitor, whose capacitance is inversely related to the reverse bias voltage applied across the varactor diode. This capacitance affects the clock oscillator frequency and causes it to change slightly. Resistors 95, 96 and 99 and grounded capacitor 97 provide a biasing function with respect to varactor diode 98, buffer amplifier 93 and oscillator crystal 100. In a preferred embodiment, the crystal oscillator oscillates at a nominal frequency of 3.6 MHz.

Capacitors 105, 106 in combination with NPN transistor 104 form a Colpitts oscillator with oscillator crystal 100 which oscillates at approximately 3.6 MHz. Capacitor 103 provides power supply filtering, while resistors 101, 102 and 107 bias transistor 104. Capacitor 108 provides AC coupling of the oscillator output of transistor 104 to the base of transistor 111. NPN transistor 111 amplifies the output of transistor 104 and isolates transistor 104 from the load on transistor 111. Resistors 109 and 110 perform a voltage dividing and biasing function with respect to NPN transistor 111, as do grounded resistor 113 and capacitor 114. NPN transistor 111 serves as an amplifier and buffer in providing an adjusted time base reference signal via AC coupling capacitor 118 on line 77 to pin 2 of clock microprocessor 80. This adjusted time base signal sequences the clock microprocessor 80 through its functions.

In addition, the adjusted time base signal is directly coupled to a complementary pair amplifier comprised of emitter-coupled PNP and NPN transistors 115, 116, which amplify and isolate the 3.6 MHz further so that it may be output via resistor 117 from the clock controller 22 and used as a reference frequency. As shown in FIG. 1, the output of the 3.6 MHz oscillator amplifier circuit may be provided via line 78 to an accessory device 36 which may, for example, be a frequency counter, for providing a timing reference signal thereto.

The output from the adjusted timing signal oscillator and amplifier circuit 90 may also be provided to an accessory interface system 20 for providing the time and date information serially to yet another accessory 21, such as a computer. The accessory interface system 20 includes a microprocessor 72 which sends the time in the same format as presented in display circuit 32 via an interface circuit 74 to accessory 21. The date information is provided from the clock controller 22 in Julian format, i.e., date of the year. The accessory microprocessor 72 converts the date into a month/day format and reads the year select switch setting from the appropriate dip switch in switch assembly 76 to compute the year and correct the date for a leap year when necessary. When the accessory 21 requests information, the accessory microprocessor 72 checks the other dip switch settings in switch assembly 76 to determine the baud rate and the number of stop bits to be used in the serial information provided from clock controller 22 via accessory interface system 20 to accessory 21.

The pin 2 input of clock microprocessor 80 is a frequency standard input and defines the rate at which the clock microprocessor executes the operating program stored therein. The adjusted time base signal provided to pin 2 has been more closely synchronized with the beginning of the minute tone provided to the pin 28 input to the clock microprocessor 80 from the received WWV signal. Microprocessor timing is thus more closely synchronized with the received WWV signals by virtue of the 1000 Hz tone provided at the beginning of each minute and the adjusted microprocessor clock signal which has been more closely synchronized with the received WWV signal timing information. It is in this manner that clock 10 is updated with WWV timing information and is adjusted for more accurate operation in between receipt of the beginning of the minute audio tones received in the WWV signal.

As previously described, binary-to-decimal decoder 86 has ten distinct outputs at $Q_0$–$Q_9$ and four input lines at A–D. When the clock microprocessor 80 applies a 4-bit binary value, binary-to-decimal decoder 86 decodes the binary value into a decimal value and causes the associated decimal output line to go high. Binary values greater than 9 are ignored and none of the output lines go high. An output line is not latched high and, therefore, an output will remain high only while the associated binary value is held on its input lines. The function of binary-to-decimal decoder 86 is basically to expand the number of output lines of the clock microprocessor 80 from 4 to 10.

The $Q_6$ output of binary-to-decimal decoder 86 is coupled via resistor 83 to the base of NPN transistor 81 and provides for the turning on of transistor 81 to permit the clock microprocessor 80 to read the status of the eight switches in switch assembly 82 at its input lines 8–15. Similarly, the $Q_7$ output of binary-to-decimal decoder 86 is provided via resistor 89 to the base of NPN transistor 87 and allows clock microprocessor 80 to read the status of the eight switches in switch assembly 84 on the same input lines. When a respective transistor is turned on, all of the poles of a respective switch assembly coupled thereto are pulled to ground if the switch is closed to permit the clock microprocessor 80 to determine which of the manually selected dip switches within each switch assembly is engaged. The respective pluralities of diodes 71, 73 coupled to the outputs of switch assemblies 82 and 84 provide isolation between the respective switch assemblies which use the same input pins of the clock microprocessor 80. In a preferred embodiment, the switches in switch assembly 82 permit any one of 24 time zones to be selected and provide a manual channel lock out capability to prevent the clock from tuning to an undesired WWV frequency. This capability is provided to permit a user to prevent the clock from tuning to a frequency which is subject to local interference and may be particularly noisy resulting in degraded timing information. Similarly, switch assembly 84 is provided with propagation delay, daylight saving time/standard time, 12/24 hour, $UTC_1$ correction, and local/GMT time select switches. These manual switches permit the clock user to exercise greater control of clock operation and the information it provides.

Figure 2:
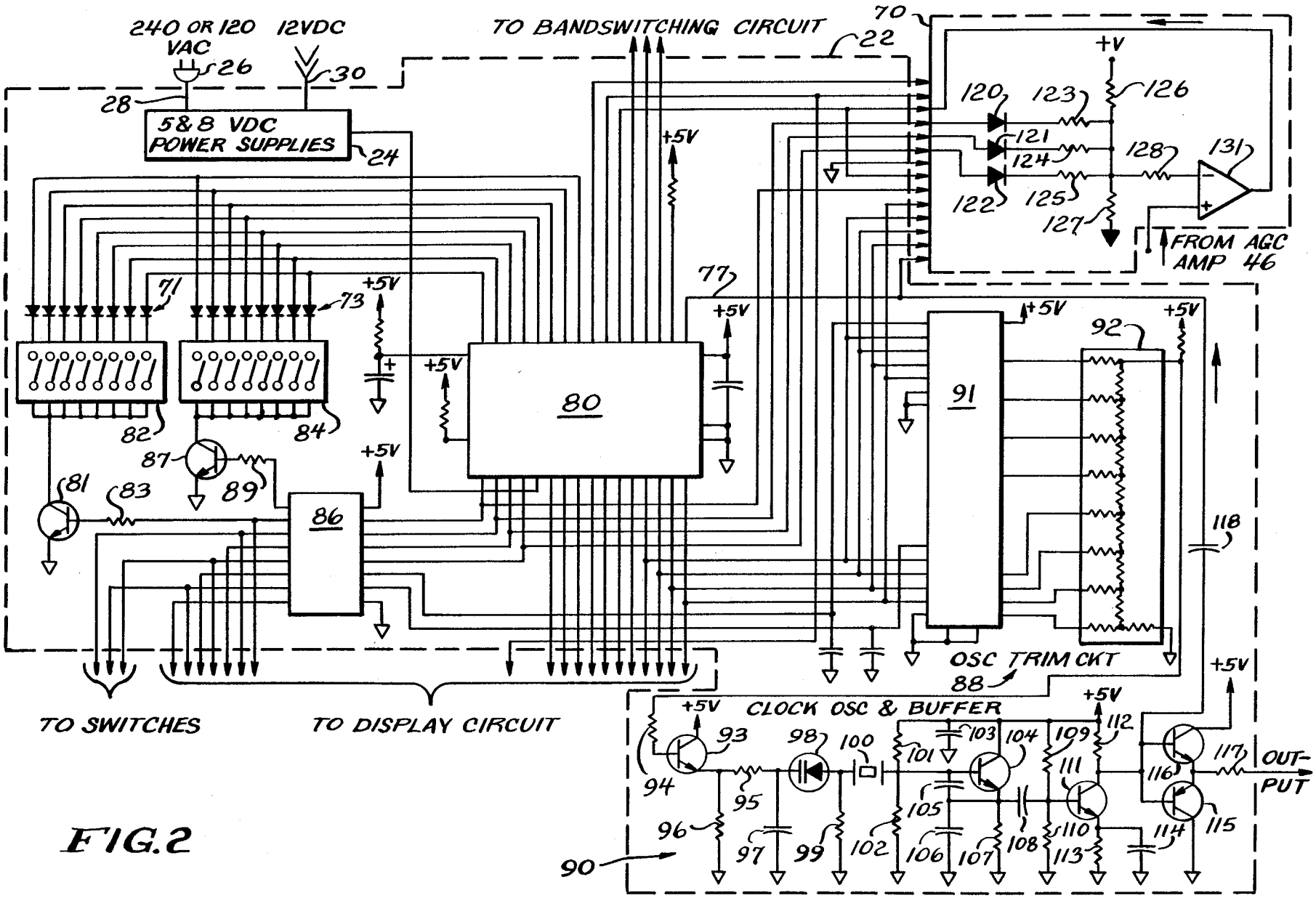
FIG. 2 is a combined schematic and block diagram of a portion of the clock of FIG. 1 showing an arrangement for correcting and updating the reference clock signal of a microprocessor therein.

Also shown in FIG. 2 is a portion of the signal level comparator 70 which is coupled to the $P_0$ port, pins 3, 4 and 5, of the clock microprocessor 80. The clock microprocessor 80 provides eight different 3-bit binary signals to diodes 120, 121 and 122 in signal level comparator 70. The voltage divider comprised of resistors 123, 124, 125, 126 and 127 converts various combinations of these signals into eight different voltages. These voltages are applied via resistor 128 to the inverting input of a comparator 131. In addition, the presence of 100 Hz tones is employed to give more "weight" to channels which are receiving these 100 Hz tones. This is done by Q403 and associated components. A +V voltage is coupled across the aforementioned resistive network by means of resistors 126 and 127. The receiver AGC voltage from the AGC amplifier 46 is provided to the noninverting input of comparator 131. Whenever the AGC voltage is less than the divider voltage at the inverting input of comparator 131, the output of comparator 131 which is provided back to input pin 30 of the clock microprocessor 80 goes low. The clock microprocessor 80 thus monitors the output voltage of comparator 131 within the signal level comparator circuit 70 of the tone decoder 18 and is thereby able to determine which of the three WWV channel levels is strongest. The clock microprocessor 80 thus controls both the voltage of the divider circuit coupled across diodes 120, 121 and 122 and the receiving channel being used. There are conditions, however, which can make a channel appear strongest when, in fact, the AGC voltage is lowest. These conditions may arise from noise or interference by other broadcasts. In this rare situation, it may become necessary to use the channel lock-out switch within switch assembly 82 so that the clock will not use such a channel.

Figure 3:
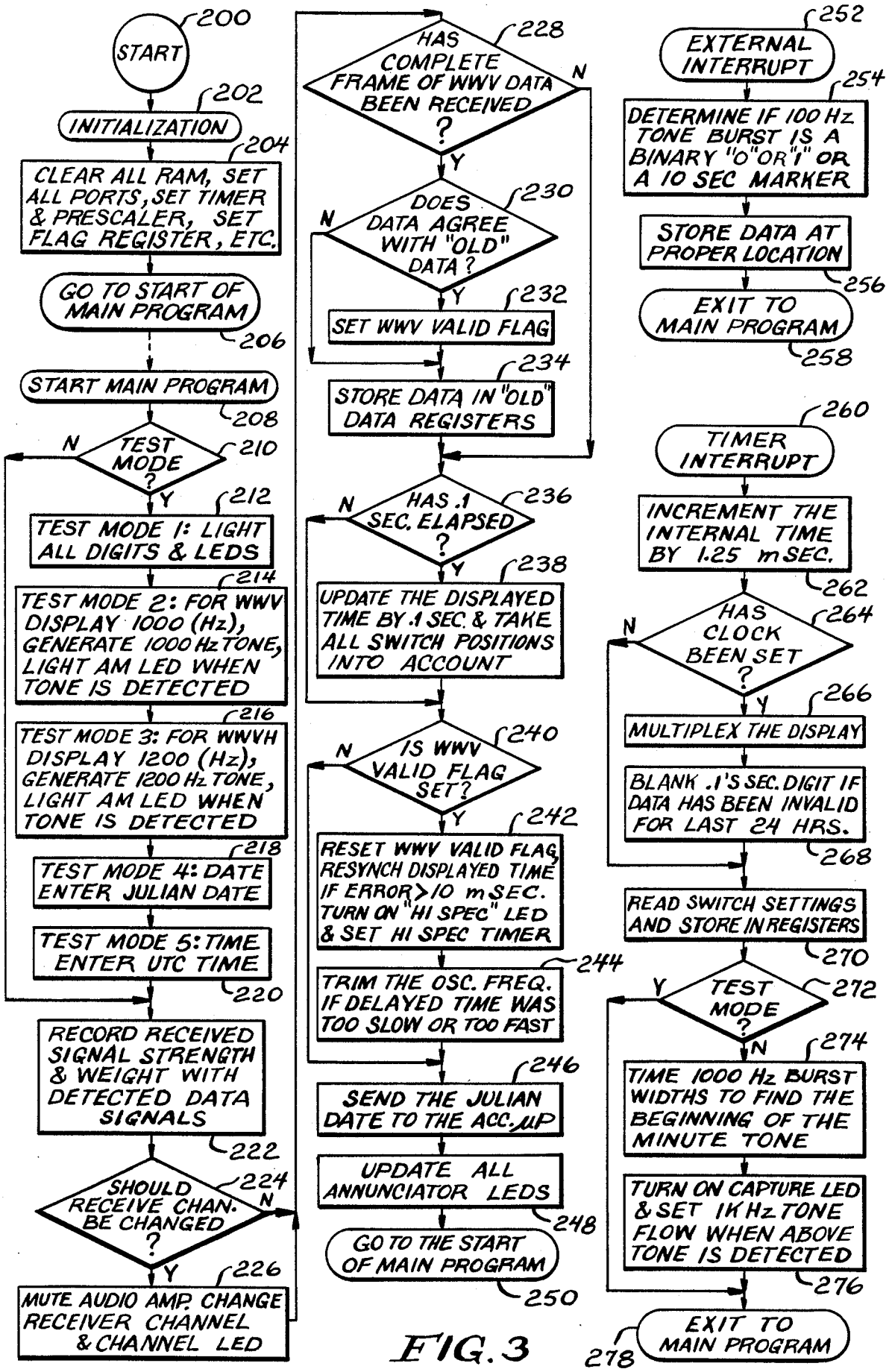
FIG. 3 is a simplified flow chart showing the steps carried out by a microprocessor in exercising control of the time corrected, continuously updated clock of the present invention.
Figure 4:
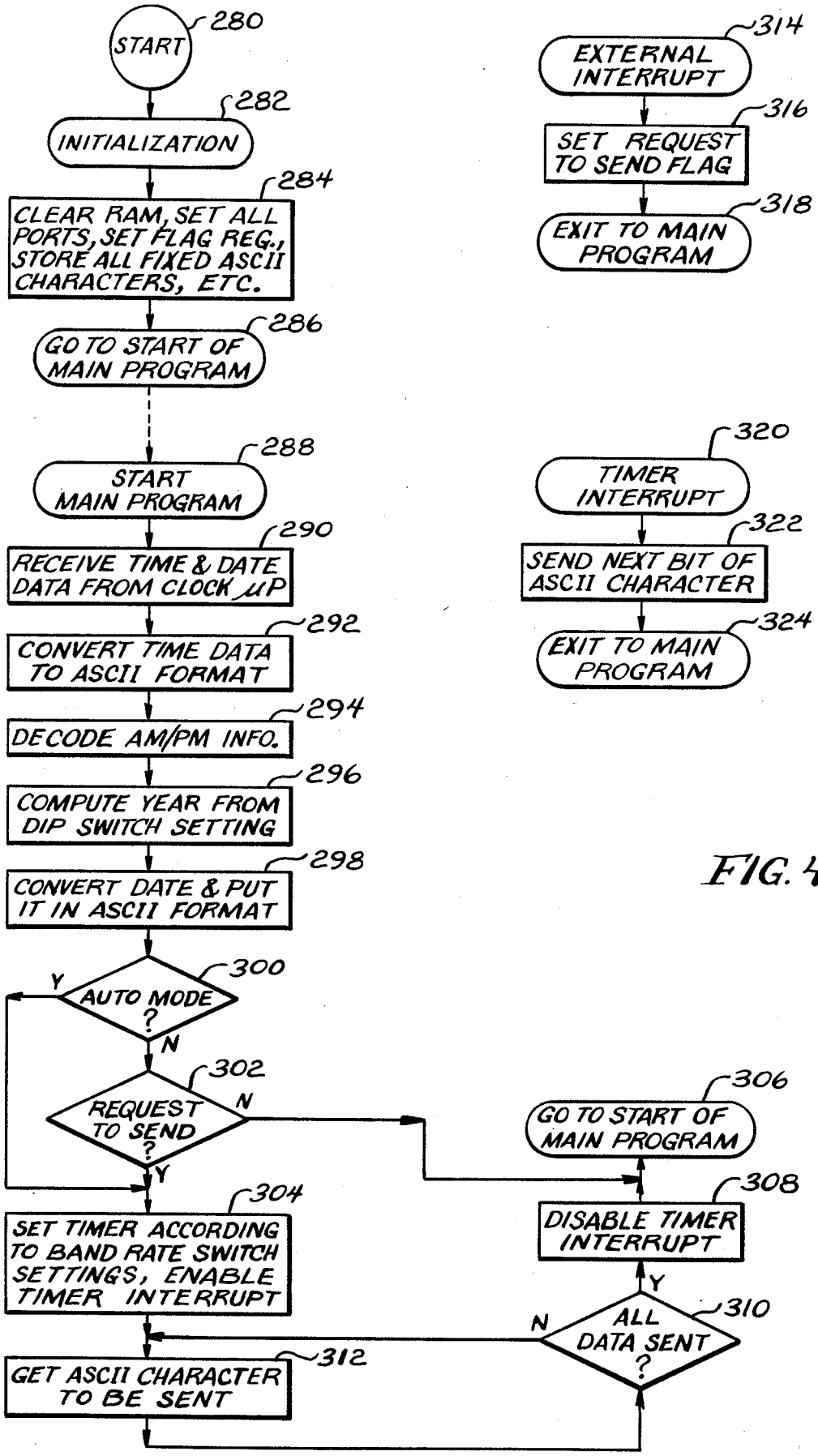
FIG. 4 is a simplified flow chart showing the steps carried out by a microprocessor in interfacing the time corrected, continuously updated clock of the present invention with an accessory device to which the timing signal of the clock is provided.

Referring to FIG. 3, there are shown various simplified flow charts illustrating the operation of the clock microprocessor 80 in exercising clock control in the four primary operations therein. The four primary operations controlled by the clock microprocessor 80 include an initialization routine, the main operating program, and external and timer interrupt routines. In FIGS. 3 and 4, an elliptical symbol indicates the start of an operational sequence, a rectangle indicates an instruction or set of instructions resulting in the performance of a control function, and a diamond indicates a decision point based upon the comparison of binary signal inputs.

The operating program of the clock microprocessor 80 starts at step 200 and initially executes an initialization routine at step 202. In the microprocessor initialization routine, its random access memory (RAM) is cleared, all of its ports are set so as to blank the display circuit 32, and various internal operating parameters are set to predetermined conditions at step 204. The operating program in the clock microprocessor 80 then proceeds to the start of the main operating program at step 206.

The microprocessor's main operating program is initiated at step 208 with an initial determination of whether the clock is in a test mode of operation made at step 210. If it is determined that the clock is not in a test mode of operation as established by switches within test circuit 34 coupled to the clock microprocessor 80, the program branches down to step 222. If at step 210 it is determined that the clock is in a test mode of operation, the operating program determines which test mode the clock is in. At step 212, test mode 1 is executed wherein all of the digits and LEDs in the display circuit 32 are illuminated. The program then executes test mode 2 at step 214 wherein a stop switch 35 in test circuit 34 is selected and digital display 32 should indicate 1000 if a 1000 Hz tone is generated with the AM LED illuminated when the 1000 Hz tone is detected. Test mode 3 at step 216 is a similar test for the 1200 Hz WWVH signal. At step 218, test mode 4 is executed and the Julian date may be entered. At step 220, the program executes test mode 5 wherein the UTC time may be manually entered.

After the execution of the aforementioned test modes, the program proceeds to step 222 where received signal strength is recorded and each of the respective received signals is weighted accordingly. This check involves monitoring the AGC voltage for each of the received channels. Each channel is scanned for 3 seconds, and the receiver is tuned to the strongest signal for approximately 15 seconds. If within this period, the clock acquires a capture signal, the beginning of the minute tone, the clock remains tuned to that channel for 1 minute or as long as it is receiving valid data.

At step 224, the program then determines if the channel should be changed based upon whether the capture light in the status LED display 140 is illuminated. If at step 224 it is determined that the WWV channel should not be changed, the program branches to step 228. However, if at step 224 the program decides that the WWV channel should be changed, the audio amplifier 54 is muted so that the received WWV tones may not be heard, the channel to which the receiver circuit 12 is tuned is changed, and the appropriate LED in the display circuit 32 is illuminated to indicate which channel is now being received. At step 228, it is determined whether a complete frame of WWV data has been received and if not, the program branches to step 236. If a complete frame of WWV data has been received, the program compares the received data with previously received data at step 230 and if both sets of data agree, sets a WWV valid flag at step 232. If both sets of WWV data do not agree, the program stores the new data where the old data was stored and prepares for receipt of data in the next WWV frame.

At step 236, the program determines if 0.1 seconds has elapsed in order to update the displayed time by 0.1 seconds and monitor the setting of all the switches in the clock. If at step 236, it is determined that 1/10 of a second has not yet elapsed, the program branches to step 240 and determines if the WWV valid flag has been set. If the WWV valid flag has not been set, the program branches to step 246 and provides the Julian date to the accessory microprocessor 72 in the accessory interface system 20. If at step 240 it is determined that the WWV valid flag has been set, the program resets the WWV valid flag, resynchronizes the display time if the clock time differs from the WWV reference time by more than 10 milliseconds, turns on the "HI SPEC" LED in the status LED display 140, and sets the "HI SPEC" timer at step 242. The program then at step 244 corrects for differences between the clock time and received WWV time by actuating the oscillator trim circuit 88 and adjusting the operating program reference time to coincide with the received WWV reference time. After the Julian date is provided to the accessory microprocessor 72 at step 246, the program updates all annunciator LEDs in the display circuit 32 at step 248 and proceeds to the start of the main operating program at step 250.

When the CAPTURE LED is on, the external interrupt is enabled. Hence, the external interrupt routine in the clock microprocessor 80 is initiated at step 252 in response to illumination of the DATA LED on the status LED display 140. At step 254 the operating program in the clock microprocessor 80 times the widths of the data bursts provided in the received WWV signals to determine if the 100 Hz tone burst is a binary 0, a binary 1, or a 10 second marker. Once it is determined whether a received pulse is a 0 or a 1, it is stored in an appropriate RAM location within the clock microprocessor 80 at step 256 and the operating program exits to the main program at step 258.

The timer interrupt routine is initiated at step 260 with a prescaler (not shown) in the clock microprocessor 80 set to determine when the timer interrupt routine will be periodically executed. Initially the timer interrupt routine increments the internal time in the clock mioroprocessor 80 by 1.25 milliseconds at step 262 and determines if the clock has been set at step 264. If the clock has not been set, the program branches to step 270 where it reads the switch settings in the clock and stores information representing the switch settings in appropriate registers in the clock microprocessor 80. If at step 264, the program determines that the clock has been set, the various LEDs in the display circuit 32 are each sequentially turned on for 1.25 milliseconds at step 266. The program then checks to see if valid WWV timing information has been received within the preceding 24 hours and, if not received, turns off the 1/10 second digit in digital display 138 indicating that the displayed timing data may be inaccurate.

At step 270, the program reads the various clock switch settings and stores this information in various registers within the clock microprocessor 80. The program then at step 272 determines whether a test mode has been selected by means of the appropriate switch in test circuit 34. If it is determined that a test mode has been selected, the program branches down to step 278 and exits the timer interrupt routine, returning to the main program at step 208 for executing the various test modes of operation. If at step 272 it is determined that a test mode has not been selected by means of test circuit 34, the program branches to step 274 and measures the width of the 1000 Hz tone bursts in order to detect a valid 1000 Hz signal tone marking the beginning of a one minute reference time interval. If a valid 1000 Hz signal is detected at step 274, the program turns on the CAPTURE LED in the status LED display 140 and sets a 1 kHz tone flag within the clock microprocessor 80. With this flag set, the program will no longer look for a valid 1000 Hz tone burst each time the timer interrupt routine is executed. Therefore, the external interrupt routine will not be enabled unless this flag is set in the clock microprocessor 80 and the CAPTURE LED is illuminated. Also, if the 1 kHz tone flag is not set, the received WWV channel will not be changed and WWV timing data will not be compared with internal clock microprocessor timing since one complete frame of data has not yet been received. When the CAPTURE LED flag is initially set at step 276, the previously received timing data is incremented by one minute. Once the CAPTURE LED is turned on at step 276, the program proceeds to step 278, exiting the timer interrupt routine and returning to the main operating program.

Referring to FIG. 4, there are shown several flow charts illustrating the operation of the accessory interface system 20 under the control of the accessory microprocessor 72. The four routines illustrated in the various flow charts in FIG. 4 for the accessory microprocessor 72 are similar to those previously discussed with respect to FIG. 3 and the clock microprocessor 80. Accessory microprocessor 72 operation is briefly described in the following paragraphs with respect to the flow charts of FIG. 4.

The program executed by the accessory microprocessor 72 is initiated at step 280 and begins with an initialization routine at step 282 wherein its random access memory (RAM) is cleared, all ports are set to a predetermined state, and various internal parameters are set within the accessory microprocessor 72 at step 284. The program then at step 286 proceeds to the start of the main operating program and begins executing the main operating program at step 288. The first step in the main operating program involves the receipt of time and date data from the clock microprocessor 80 at step 290 whereupon the accessory microprocessor 72 converts the time data to ASCII format at step 292. The program then decodes AM/PM information at step 294 and computes the year from the position of dip switches in the switch assembly 76 at step 296. The date received from the clock microprocessor 80 is then converted from Julian to a Gregorian date and put into ASCII format at step 298. The program then at step 300 determines if the accessory interface system is in an automatic mode and, if so, branches to step 304 where a timer in the accessory microprocessor 72 is set according to the position of a baud rate dip switch in switch assembly 76 and a timer interrupt is enabled.

The accessory microprocessor 72 then provides the ASCII character to the interface circuit 74 at step 312 for transmission to the accessory device 21 and continues to provide data for transmission to the interface circuit 74 until the program determines at step 310 that all data has been sent. Once it is determined that all the data has been transmitted to the accessory device 21, the timer interrupt routine is disabled at step 308 and the program returns to the start of the main operating program at step 306. If at step 300 it is determined that the accessory interface system 20 is not in the automatic mode of operation, the program then determines whether a request to send data has been received from accessory device 21 at step 302. If a request for data has been received, the program branches to step 304 and prepares to send the requested time and data data to accessory device 21. If a request for data has not been received from accessory device 21, the program branches to step 306 and returns to the start of the main operating program.

An external interrupt routine is initiated at step 314 and involves the setting of a request-to-send flag in the accessory microprocessor 72 at step 316 in preparation for the transmission of time and date data to the accessory device 21. The external interrupt routine then returns to the main operating program at step 318. A timer interrupt routine is initiated at step 320 and involves the transmission of data in the form of ASCII character at step 322 from the accessory interface system 20 to the accessory device 21. After each bit of data is transmitted to accessory device 21, the timer interrupt routine returns to the main operating program at step 324.

There has thus been shown a time corrected, continuously updated clock which is responsive to time-based received RF signals for periodically updating the timing of a microprocessor controller to coincide with received signal timing information to provide more accurate clock operation in between its periodic updates.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A clock responsive to time-based signals for keeping time in accordance therewith, said time-based signals including encoded timing information, said clock comprising:

receiver means for receiving said time-based signals;

decoder means coupled to said receiver means for processing said time-based signals and deriving said timing information therefrom;

control means responsive to a timing reference signal for controlling the operation of said clock in accordance therewith, said control means coupled to said decoder means and responsive to said timing information for comparing said timing information and said timing reference signal and generating a correction signal representing the time difference between said timing information and said timing reference signal;

variable oscillator means coupled to said control means and responsive to said correction signal for adjusting said timing reference signal so as to coincide with said timing information and providing the thus adjusted timing reference signal to said control means in synchronizing said control means with said timing information, wherein said variable oscillator means comprises an oscillating network which includes a fixed frequency oscillator in combination with variable capacitance means coupled to said control means and responsive to said correction signal.

2. A clock in accordance with claim 1 wherein said correction signal is a variable DC voltage and said variable capacitance means includes a varactor diode responsive to said variable DC voltage.

3. A clock in accordance with claim 1 further including user-responsive switch means coupled to said control means for providing a time correction factor including a time-based signal propagation delay adjustment component thereto.

4. A clock in accordance with claim 1 further including user-responsive switch means coupled to said control means for providing a time correction factor for compensating for variations in the rotation of the earth for coordinating the operation of the clock with solar time.

5. A clock in accordance with claim 1 further including light means coupled to said decoder means for providing a visual indication of the receipt of said time-based signals by said clock.

6. A clock in accordance with claim 5 wherein said light means includes a light emitting diode.

7. A clock in accordance with claim 1 further including a frequency counter coupled to said variable oscillator means for receiving said adjusted timing reference signal and operating in accordance therewith.

8. A clock in accordance with claim 1 further including a computer coupled to said variable oscillator means for receiving and operating in accordance with the timing of said adjusted timing reference signal.

9. A clock in accordance with claim 1 wherein said time-based signals are provided in sequence at a plurality of different frequencies and said clock further includes bandswitching means coupled to said control means and to said receiver means for switching said receiver means to one of said plurality of frequencies.

10. A clock in accordance with claim 9 further including signal strength detection means coupled to said receiver means and to said control means and responsive to received signal strength for providing a bandswitch signal to said receiver means in automatically switching said clock to the frequency of the strongest received time-based signal.

11. A clock in accordance with claim 10 wherein said control means is further responsive to said timing information for switching said receiver means to the one of said plurality of frequencies in accordance with which of said time-based signals contains the most accurate timing information.

12. A clock responsive to time-based signals for keeping time in accordance therewith, said time-based signals including encoded timing information, said clock comprising:

receiver means for receiving said time-based signals;

decoder means coupled to said receiver means for processing said time-based signals and deriving said timing information therefrom;

control means responsive to a timing reference signal for controlling the operation of said clock in accordance therewith, said control means coupled to said decoder means and responsive to said timing information for comparing said timing information and said timing reference signal and generating a correction signal representing the time difference between said timing information and said timing reference signal;

variable oscillator means coupled to said control means and responsive to said correction signal for adjusting said timing reference signal so as to coincide with said timing information and providing the thus adjusted timing reference signal to said control means in synchronizing said control means with said timing information; and digital to analog conversion means coupling said control means to said variable oscillator means for converting said correction signal to a DC voltage and providing said DC voltage to said variable oscillator means.

13. A clock responsive to time-based signals for keeping time in accordance therewith, said time-based signals including encoded timing information, said clock comprising:

receiver means for receiving said time-based signals;

decoder means coupled to said receiver means for processing said time-based signals and deriving said timing information therefrom;

control means responsive to a timing reference signal for controlling the operation of said clock in accordance therewith, said control means coupled to said decoder means and responsive to said timing information for comparing said timing information and said timing reference signal and generating a correction signal representing the time difference between said timing information and said timing reference signal;

variable oscillator means coupled to said control means and responsive to said correction signal for adjusting said timing reference signal so as to coincide with said timing information and providing the thus adjusted timing reference signal to said control means in synchronizing said control means with said timing information; and visual display means coupled to said decoder means and responsive to said timing information for providing a visual indication of when accurate timing information is being received.

14. A clock in accordance with claim 13 wherein said visual display means is blanked if the clock is not updated within a predetermined interval by the receipt of said encoded timing information.

15. A clock in accordance with claim 13 wherein said visual display means is illuminated only after accurate timing information is received for a time period of predetermined length.

* * * * *